US008074548B2

(12) United States Patent
Ice

(10) Patent No.: US 8,074,548 B2
(45) Date of Patent: Dec. 13, 2011

(54) FRINGE CUTTER FOR TIE AND CUT BLANKETS AND PILLOWS

(76) Inventor: Catherine Lynn Ice, Romeoville, IL (US)

( * ) Notice: Subject to any disclaimer, the term of this patent is extended or adjusted under 35 U.S.C. 154(b) by 363 days.

(21) Appl. No.: 12/422,272

(22) Filed: Apr. 12, 2009

(65) Prior Publication Data

US 2009/0255131 A1 Oct. 15, 2009

Related U.S. Application Data

(60) Provisional application No. 61/044,478, filed on Apr. 12, 2008.

(51) Int. Cl.
*B26D 1/30* (2006.01)

(52) U.S. Cl. ..... 83/599; 83/607; 83/936

(58) Field of Classification Search ..... 83/607, 83/608, 609, 599, 598, 601, 932, 936
See application file for complete search history.

(56) References Cited

U.S. PATENT DOCUMENTS

| | | | | | |
|---|---|---|---|---|---|
| 486,917 | A * | 11/1892 | Walker | 225/103 |
| 949,462 | A * | 2/1910 | Colley | 83/598 |
| 2,263,466 | A * | 11/1941 | McCarthy | 83/397 |
| 2,558,044 | A * | 6/1951 | Emmer | 83/571 |
| 3,833,447 | A * | 9/1974 | Gustafson | 156/505 |
| 4,951,540 | A * | 8/1990 | Cross et al. | 83/397 |
| 2002/0038592 | A1 * | 4/2002 | Hunn et al. | 83/523 |

* cited by examiner

*Primary Examiner* — Stephen Choi
(74) *Attorney, Agent, or Firm* — Michael Ries

(57) ABSTRACT

A fabric cutter for making a fringe on an edge of a fabric having a base member, a lever member; and a row of blades for cutting a fringe in the edge of a fabric, the lever member being pivotally attached to said base member and having suspended there from the row of blades; the base member having rectangular cutting slots with sharp edges corresponding in position to a lower end of each blade of the row of blades, the cutting slots being adapted to permit penetration there through of the plurality of blades upon lowering the lever member toward the base member to cut a fringe in the edge of a fabric located between the row of blades and the rectangular cutting slots.

5 Claims, 3 Drawing Sheets

FRINGE CUTTER FOR TIE AND CUT BLANKETS AND PILLOWS

This application claims priority to U.S. Provisional application Ser. No. 61/044,478, filed 12 Apr. 2008 which is incorporated herein by reference in its entirety

BACKGROUND OF THE INVENTION

1. Field of the Invention

This invention relates to cloth cutters and more particularly to cutters for forming a fringe on the edge of a fabric.

2. Description of the Related Art

To make a tie and cut blanket or pillow, a person layers two fabrics each fabric having two or more yards of material, one on top of the other, with the edges of the two layers being in alignment with each other. One layer will become the top of the blanket and the other layer will be the back. At this time the two layers can be pinned together. However, it has been found that the layers will remain aligned and not move relative to each other when not pinned. In addition, not pinning saves a step in preparing the layered fabrics for fringing.

Prior to creating a 4 inch fringe alone each edge of the layered fabrics, a 4×4 inch square is cut out of each corner of the layered fabrics and is discarded. A tape measure across the top of the four inch cuts that are to be made can be used to help make the strips are about 1 inch wide and only four inches deep. Now, using hand operated scissors, 4 inch slits are cut into the layered fabrics at 1" intervals around all four sides.

It is here noted, for example, that a significant amount of time will be spent measuring and marking the layered fabrics where the slits are to be made, and if the layered fabrics measures 50 inches by 70 inches, about 240 slits will be cut into the layered fabrics that are one inch wide and four inches long by a person with a hand operated scissors.

A pair of very sharp scissors is required. If the scissors are dull, it will take a lot longer to complete and require a significant amount of effort.

After the cuts are made around all four sides of the layered fabrics, one strip from the front fabric and one strip from the back fabric are tied with an overhand knot to close the blanket edge and create a finished fringe edge.

A faster and easier way of cutting a fringe in at least one fabric is needed. The present invention may be used for blankets or pillows or any other product needing fabric cut to at least one string like length around the perimeter of a piece of material.

SUMMARY OF THE INVENTION

To overcome the shortcomings noted above, there is disclosed a fabric cutter for making a fringe on an edge of a fabric comprising:

a base member, a lever member; and a row of blades for cutting a fringe in the edge of a fabric, said lever member being pivotally attached to said base member and having suspended there from said row of blades;

said base member having rectangular cutting slots with sharp edges corresponding in position to a lower end of each blade of said row of blades, said cutting slots being adapted to permit penetration there through of said plurality of blades upon lowering said lever member toward said base member to cut a fringe in the edge of a fabric located between the row of blades and the rectangular cutting slots.

The foregoing has outlined, rather broadly, the preferred feature of the present invention so that those skilled in the art may better understand the detailed description of the invention that follows. Additional features of the invention will be described hereinafter that form the subject of the claim of the invention. Those skilled in the art should appreciate that they can readily use the conception and specific embodiment as a base for designing or modifying the structures for carrying out the same purposes of the present invention and that such other features do not depart from the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals.

DETAILED DESCRIPTION OF THE INVENTION

Figure 1:
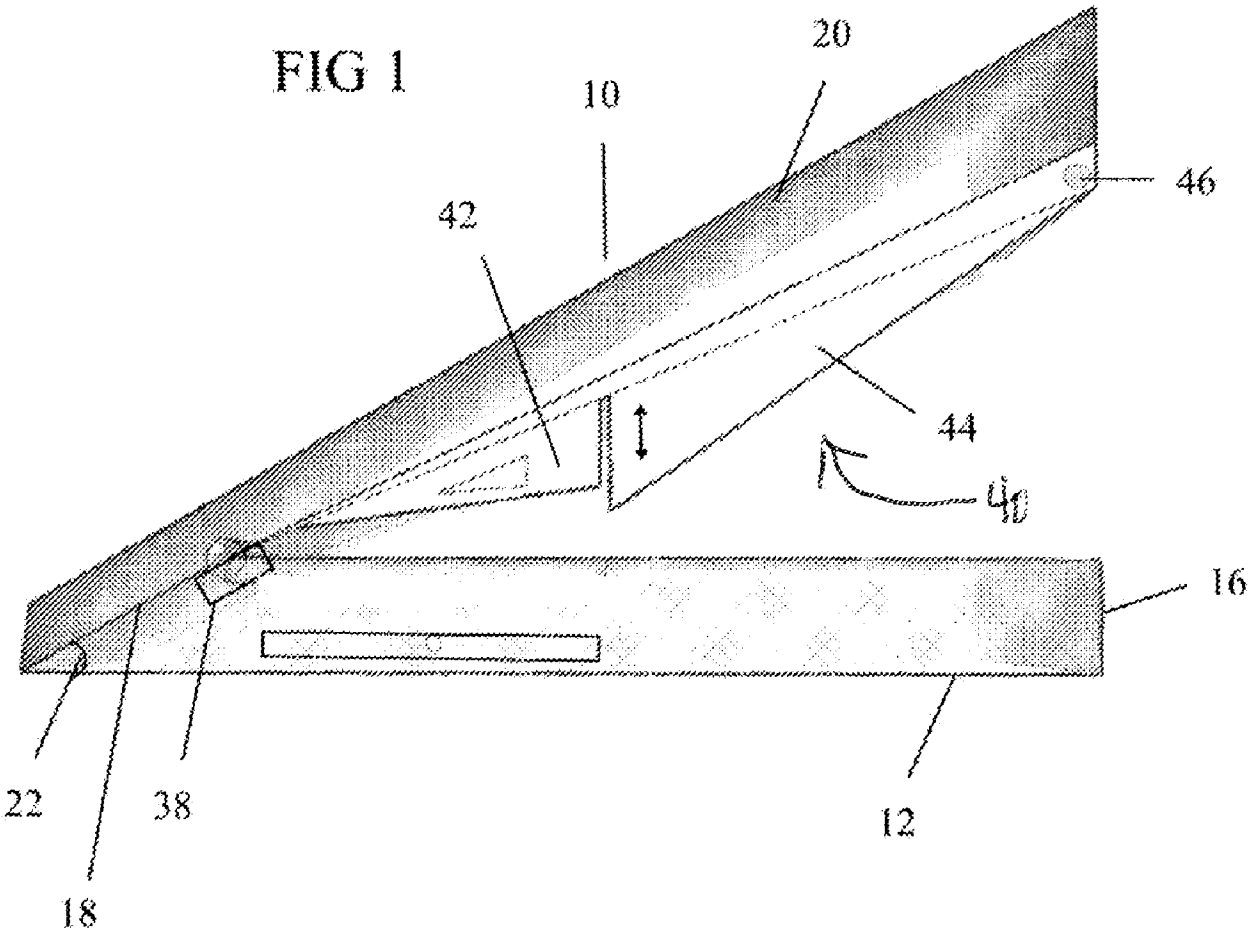
FIG. 1 is a side view of a ten strip fringe cutter showing a guard member in its extended position according to an embodiment of the invention.
Figure 2:
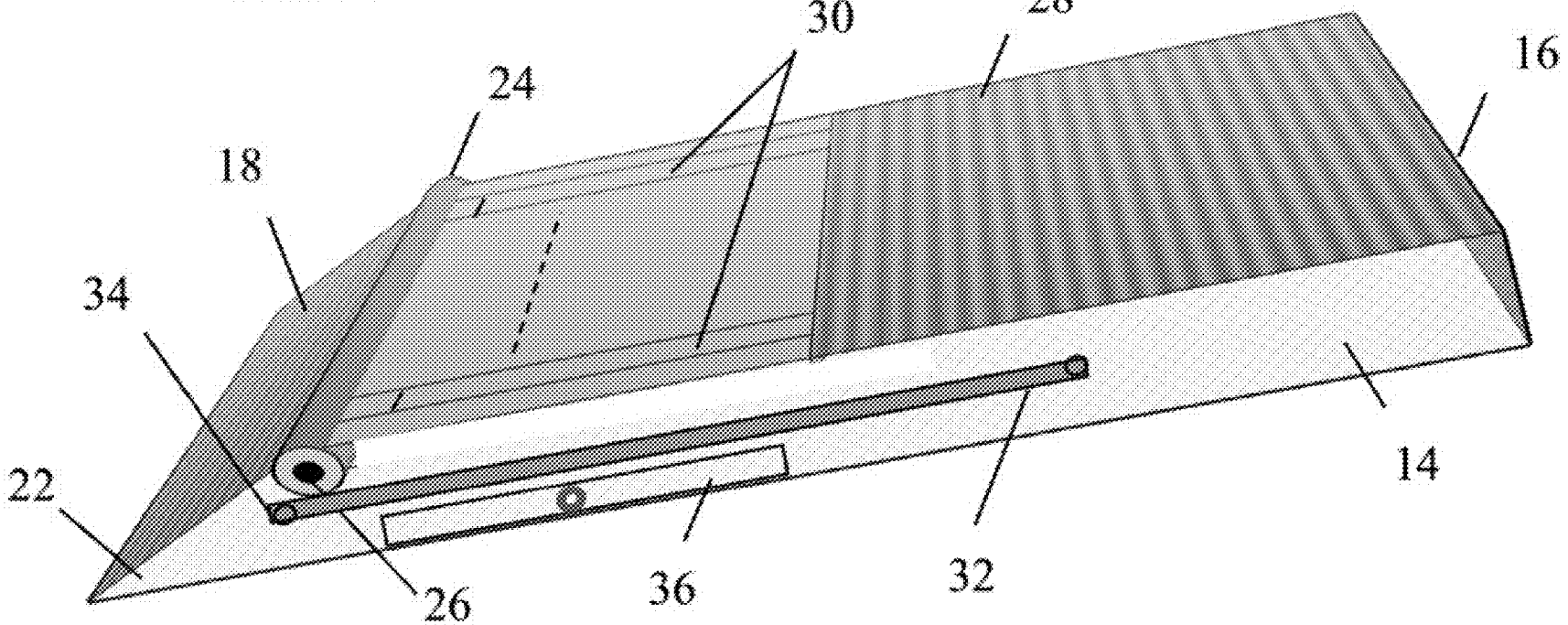
FIG. 2 is a perspective view of the base member of the ten strip fringe cutter showing rectangular openings for receiving fringe cutting blades.
Figure 3:
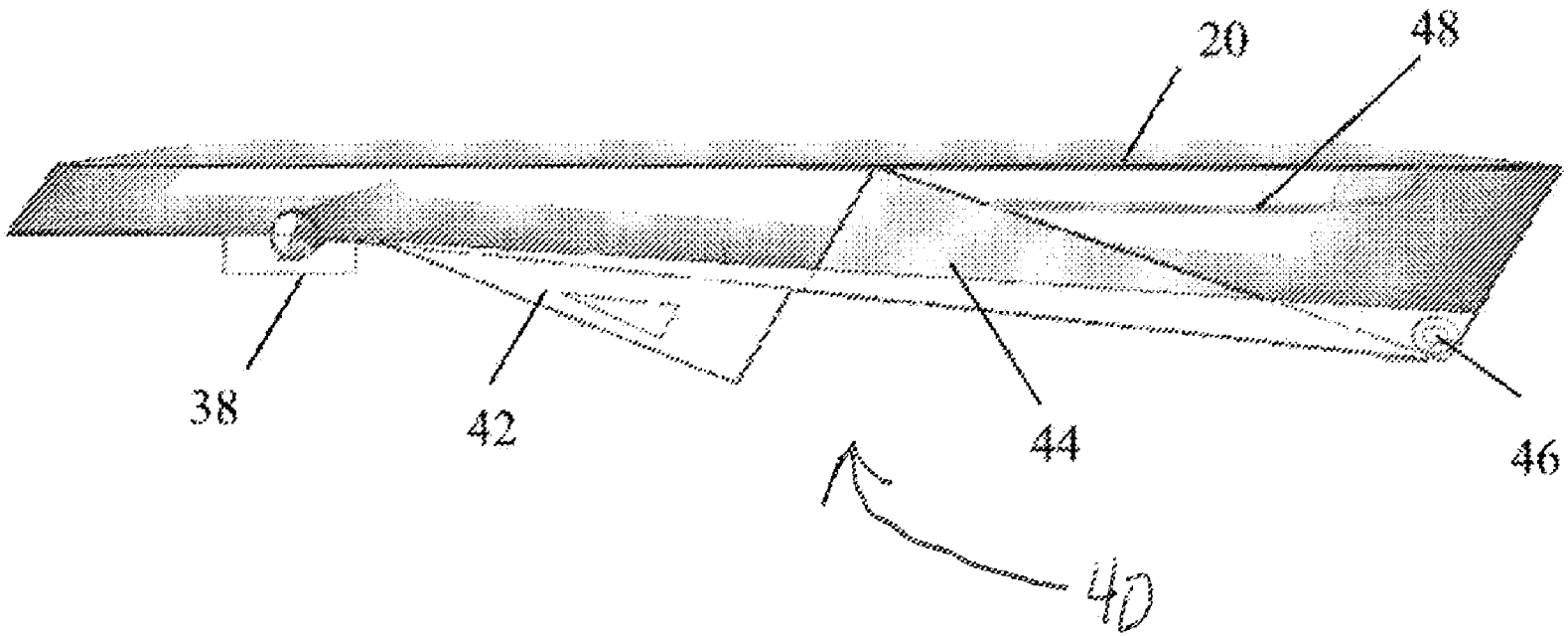
FIG. 3 is a partial sectional side view of the lever member of the ten strip fringe cutter showing the guard member in its retracted position.

Referring to FIGS. 1-3, the fringe cutter assembly 10 includes a base member 12 formed of sheet steel or plastic having two side sections 14, a front section 16 and a rear section 18. The base member is pivotly coupled to lever member 20.

Looking at FIG. 2, the rear section 18 of the base member is sloped at an angle 22 of approximately 30 degrees. The rear section functions as a stop to limit the opening between the base member and the lever member. The angle of the rear section 18 can be increased up to 90 degrees to allow the lever member 20 to open a full 90 degrees or the angle of the rear section can be at, for example 45 degrees to provide a larger opening between the lever member and the base member. Located between the top end of the rear section 18 and the top 28 of the base member, and securely coupled to the base member, is a tube member 24 having an opening 26. Opening 26 is for receiving a hinge pin which, when coupled at its ends to the lever member, allows the lever member to be pivotly coupled to the base member.

The top of the base member supports a plurality of rectangular openings 30 having sharp metal edges. The rectangular openings or slits are sized to receive and provide a cutting action with cutting blades. The edges of the rectangular openings and the cutting blades are designed to cut a fabric located on top of the openings as the cutting blade is urged to move into the rectangular opening.

The top of the base member supports eleven rectangular openings which will permit eleven cuts to be made simultaneously. It is understood, however, that the number of rectangular openings having sharp metal cutting edges can be greater or less than eleven. The number of openings in the top of the base member is determined by the number of cuts and, therefore, the number of strips that are to be made simultaneously.

Located on each side 14 of the base member is a spring clip 32. Each spring slip is attached to a side 14 with a pin 34. The spring clips are provided to hold in place a cloth which is positioned on top of the rectangular openings. The spring clips have a length that is more that four inches to permit them to capture a cloth where one part has been cut with a fringe of four inches.

Located in one side 14 of the base member below the spring clip 32 and under the various openings or slits 30 is a pull out draw 36. Draw 36 is provided to collect threads, cuttings or other material which falls or is pushed down through the openings 30.

Referring to FIG. 1, lever member 20 supports a downward extending member 38 having an opening 40 for receiving a pin. The opening 40 is provided to receive a hinge pin which passes through each opening 40 in the two sides of lever member and opening 26 in the tube member 26 to allow lever member to rotate relative to the base member. Located near the hinge is a set of cutter blades 42. In the embodiment here disclosed, there are eleven cutter blades where each blade is four inches long and the blades are positioned one inch apart. The cutting blades shown have a straight sharp edge. However, the cutting edge of each blade can have an inverted V shape. With this embodiment, each time the lever member is moved down, a fringe having ten strips of fabric are made where each strip is one inch wide and four inches long.

The cutter blades are firmly secured to the inside surface of the lever member with, for example an epoxy or some other material, and they are positioned to be in alignment with rectangular openings or slits in the base member. Thus, as the lever member is moved down toward the base member, each cutter blade will be in alignment with and be received by a rectangular opening 30 which is a receiving slit in the base member for receiving the cutting blade. The cutter blades can be of equal size so that they all contact a fabric located on top of the rectangular openings at the same time, or the cutting blades can be of different sizes or shapes to allow them to contact a fabric sequentially.

Continuing with FIG. 1, located in front of the cutting blades 40 is a guard member 44. Guard member 44 is pivotally coupled to the lever member with a pin 46 which passes through the sides of the lever member and the guard member. The guard member is free to assume an extended position as is shown in FIG. 1 or a recessed position as is shown in FIG. 3. Guard member 44 is made of a single piece of material such as plastic or rubber, is triangular in shape and is sized to fit in front of all of the cutting blades. The guard member is provided to prevent a user from accidentally contacting the blades 42.

Looking at FIG. 3, guard member 44 is shown in its recessed position. A leaf spring 48 which is attached to the inside surface of the cover is positioned to contact and urge the guard member to assume its extended position.

When the lever member is raised, the guard member is urged to assume its extended position by spring 48. As lever member is being moved down toward the base member, the guard member will contact the top 28 of the base member and be urged to move up into the lever member as the lever member and cutting blades continue to move down.

In operation, the edges of two layered cloths are positioned on the surface 28 of the base member and locked in position by spring clips 32, and lever member is moved down toward base member. As the cutting blades of the lever member contact the layered cloth, the guard member is urged to move up into the lever member by the base member as the cutting blades press into and begin to cut the layered cloths. Continued downward movement of the cutting blades into the eleven rectangular openings will make a fringe of 10 uniform strips of fabric four inches long and one inch wide in the edge of the two layers of fabrics.

Thus, the fringe forming structure of the present invention can be used independently to cut up to ten or more strips of layered fabric with one action of its lever without requiring a user to measure the fabric.

Although a few examples of the present invention have been shown and described, it would be appreciated by those skilled in the art that changes might be made in this embodiment without departing from the principles and spirit of the invention, the scope of which is defined in the claims and their equivalents.

What is claimed is:

1. A fabric cutter to make a fringe on an edge of a fabric comprising:

a base member with an adjustable rear section with a top end and two sides;

a lever member wherein said adjustable rear section forms an angle of approximately 30 degrees between said base member and said lever member wherein a tube member disposed on said top end with an opening to accommodate a hinge pin that allows said lever member to be pivotally coupled to said base member and said adjustable rear section is sloped at said angle up to approximately 90 degrees to allow said lever member to open up to approximately 90 degrees to provide a larger opening between said lever member and said base member;

a row of blades each with an inverted V shaped cutting edge to cut said fringe in the edge of a fabric, said lever member being pivotally attached to said base member and having suspended there from said row of blades has at least 5 blades to make fringe of four strips of said fabric;

a slide out tray located beneath the rectangular cutting slots located in the base member;

a guard member located in front of each blade of said row of blades; and said base member having a plurality of rectangular cutting slots with a plurality of sharp edges corresponding in position to a lower end of each blade of said row of blades, said cutting slots being adapted to permit penetration there through of said plurality of blades upon lowering said lever member toward said base member to cut a fringe in the edge of a fabric located between the row of blades and the rectangular cutting slots.

2. The fabric cutter of claim 1, wherein each blade of said row of blades has an approximate four inch cutting edge to produce an approximate 4 inch said fringe along each said edge of said fabric.

3. The fabric cutter of claim 1, wherein the spacing between each blade of said row of blades is approximately one inch.

4. The fabric cutter claim 1, wherein said row of blades are approximately four inches long and approximately one inch apart.

5. The fabric cutter of claim 1, wherein said base member has a spring clip on each said side to engage a fabric.

* * * * *